US005084731A

United States Patent [19]

Baruch

[11] Patent Number: 5,084,731

[45] Date of Patent: Jan. 28, 1992

[54] SHEET DECURLING MECHANISM AND METHOD

[75] Inventor: Susan C. Baruch, Rochester, N.Y.

[73] Assignee: Eastman Kodak Company, Rochester, N.Y.

[21] Appl. No.: 632,786

[22] Filed: Dec. 24, 1990

[51] Int. Cl.[5] ..... G03G 21/00

[52] U.S. Cl. ..... 355/208; 162/271; 355/282; 355/290; 355/311

[58] Field of Search ..... 355/208, 282, 285, 289, 355/290, 309, 308, 311; 162/270, 271; 271/272, 273, 274; 493/459

[56] References Cited

U.S. PATENT DOCUMENTS

| | | | |
|---|---|---|---|
| 4,326,915 | 4/1982 | Mutschler, Jr. | 162/271 |
| 4,505,695 | 3/1985 | Billings | 162/271 X |
| 4,627,718 | 12/1986 | Wyer | 355/311 |
| 4,632,533 | 12/1986 | Young | 355/309 |
| 4,926,358 | 5/1990 | Tani et al. | 355/311 X |
| 4,952,281 | 8/1990 | Akira | 162/270 |
| 5,005,050 | 4/1991 | Donivan et al. | 355/208 |

*Primary Examiner*—A. T. Grimley
*Assistant Examiner*—Robert Beatty
*Attorney, Agent, or Firm*—Tallam I. Nguti

[57] ABSTRACT

An electrostatographic fusing apparatus includes a sheet decurling mechanism that has a curl indicating device and a pair of selectable sheet decurling nips formed by a set of hard rollers and a soft roller. The curl indicating device predicts the degree of toner particle laydown of a toned image on an image frame from the value of charge on such frame relative to a given standard charge value of charge. A copy sheet receiving toned images from an image frame having a charge value higher than such standard charge value is selectively deflected through a first decurling nip where the soft roller directly contacts the toned image side of such a copy sheet in order to induce therein a convex curl.

16 Claims, 2 Drawing Sheets

SHEET DECURLING MECHANISM AND METHOD

BACKGROUND OF THE INVENTION

Technical Field

This invention relates generally to electrostatographic process machines such as a copier or printer for producing toner images on receiver sheets, and more particularly to a fusing apparatus, in such a machine, which includes a receiver sheet decurling mechanism and a method of decurling a toned sheet.

Electrostatographic process machines such as copiers and printers, which, for example, produce or reproduce toned images on selected substrates by employing electrostatic charges and toner particles on an image-bearing surface (IBS) such as a photoconductive surface are well known. Typically, such machines operate through a sequence of currently well known electrostatographic process steps. In a copier or printer type of such machines, for example, these steps include (1) charging of an insulated photoconductive surface with electrostatic charges, (2) forming a latent image electrostatically on such surface by selectively discharging areas on such surface, (3) developing the electrostatic image so formed with particles of toner, (4) transferring the toned image to a suitable receiver sheet for fusing thereon by a fusing apparatus to form a hard copy, and (5) cleaning the photoconductive surface by removing residual toner and/or other particles therefrom in preparation for similarly reusing such surface to produce another such image.

In the above process, the quantity of toner particles, which forms each toned image on an imaging frame of the IBS, depends significantly on the quantity or level of charge on the image bearing member just before image development. The quality of the fused hard copy obtained depends in part on the condition, for example the flatness, of the receiver sheet especially following the fusing step.

Unfortunately however, in an electrostatographic machine that includes a fusing apparatus having a soft surface heated fuser roller that forms a fusing nip with a hard surface pressure roller, fused receiver sheets tend to curl undesirably following the fusing step. For example, a receiver sheet which has a substantially heavy quantity of toner particles forming the image transferred thereto when fused by such apparatus usually tends to have an undesirable concave curl in the toner image-carrying side of such sheet. On the other hand, a receiver sheet which is carrying a lightly toned image usually has instead an undesirable convex curl in the image-carrying side thereof when fused by such apparatus. Such concave and convex curls are undesirable not only because they detrimentally affect the quality and appearance of the finished hard copy, but also because such curls make handling of the receiver sheets difficult thereafter.

SUMMARY OF THE INVENTION

It is an object of the present invention to provide in an electrostatographic process machine, such as a copier or printer for producing hard copy images on a receiving sheet, a mechanism for effectively decurling such a sheet.

It is another object of the present invention to provide a heat and pressure roller-type fusing apparatus, in an electrostatographic process machine, that includes a sheet decurling mechanism.

In accordance with the present invention, a post-fusing decurling mechanism is provided in an electrostatographic process machine for removing undesirable concave and convex curls induced in the toner particle image-carrying side of a receiver sheet being used therein. The decurling mechanism includes a first means, which has a first hard roller and a soft roller which form a first decurling nip, such that the soft roller directly contacts the toner image-carrying side of a receiver sheet being fed into decurling contact through such first decurling nip. The decurling contact in the first decurling nip induces a desirable convex curl in the image-carrying side of the receiver sheet.

The decurling mechanism also includes a second means, which has a second hard roller and a soft roller forming a second decurling nip, such that the second hard roller thereof directly contacts the toner image side of a receiver sheet being fed into decurling contact through such second decurling nip. The decurling contact in the second decurling nip induces a desirable concave curl in the image-carrying side of the receiver sheet.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENT

Because electrostatographic reproduction apparatus or machines are well known, the present description will be directed in particular to elements forming part of or cooperating more directly with the present invention. Elements not specifically shown or described herein are selectable from those known in the prior art.

Figure 1:
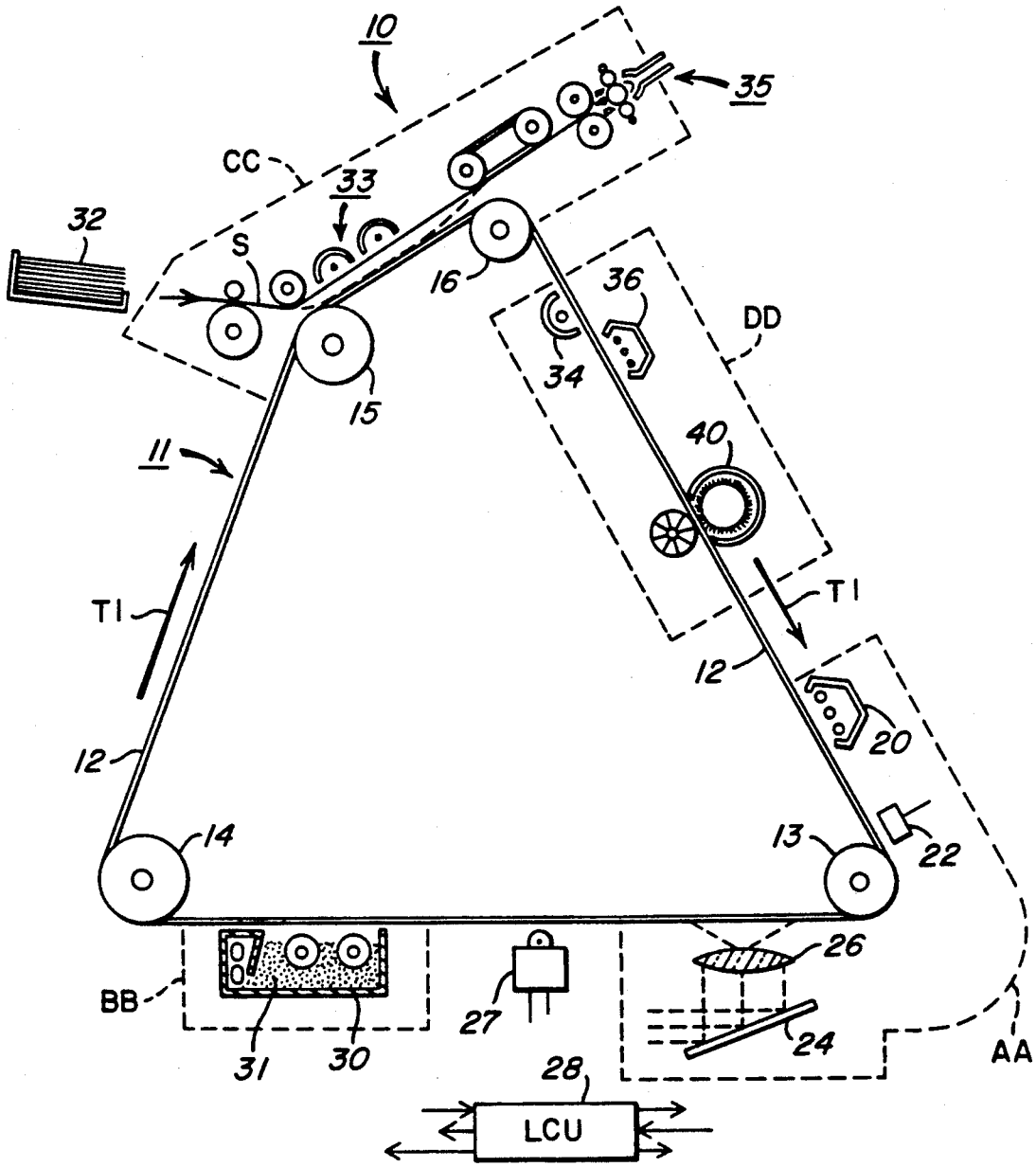
FIG. 1 is a schematic of an electrostatographic process machine, such as a copier or printer, including the mechanism of the present invention.

Referring now to FIG. 1, an electrostatographic reproduction apparatus or machine such as an optical copier is shown generally as 10. The apparatus 10, as shown, includes an image-bearing member 11 which is an endless flexible belt which has a frontside image-bearing surface 12 divided into image frame areas. Although the member 11 is shown as an endless flexible web, it should be understood that an image bearing member in the form of a rigid drum can be used instead. The member 11 as shown is trained about a series of rollers 13–16 for movement in the direction, for example, of the arrow T1. One of such rollers, for example, the roller 13, can be a drive roller for repeatedly moving the member 11 sequentially through a series of process stages shown, for example, as AA, BB, CC and DD.

As shown in FIG. 1, clean and charge-free image frame portions of the image-bearing member 11 initially move through the stage AA where a charging device 20 uniformly charges the image-bearing surface (IBS) 12 with electrostatic charges to a first potential having a desired first polarity. The electrostatic charges on the IBS 12 are then used in one manner or another (as is well known in the art) to electrostatically form, on each image frame portion of the surface 12, a latent image pattern of an original document. For example, such an image pattern can be formed by selectively discharging areas of the uniformly charged image frame portion of the surface 12, for example, to a second desired potential. Such selective discharging can be achieved, for example, using an electronic printhead 22 or the like, and/or using an optical system as shown partially. A typical optical system includes a light source (not shown) that illuminates a document sheet. The light rays reflected from the document sheet can then be reflected by a mirror shown as 24, through a lens 26, and onto the surface 12 for such optical imaging.

In accordance with particular features of the present invention, the copier or printer 10 includes a suitable device such as an electrometer 27 that is capable of measuring and summing or integrating up the quantity of charge remaining on each image-wise discharged image frame portion following such selective discharge. Alternatively, the electrometer may be used to determine the average level of charge over the area of each image frame. The copier or printer 10 also includes a logic and control unit 28 that includes means coupled to the electrometer, for example, for comparing the charge measurement by the device 27 against a predetermined average or standard charge value that can be stored as part of the control programs of the LCU 28.

As is known in the art, the logic and control unit (LCU) 28 is used for controlling the functions of the various stations and components of the electrostatographic copier or printer 10 based, for example, on the sensed instantaneous location of the moving image-bearing member 11. The LCU 28 for example has a digital computer, preferably a microprocessor which includes stored programs that are responsive to sensed input signals for sequentially actuating and deactuating the various process stations and components of the copier or printer 10, as well as for controlling the various functions of each such station and component. The image-bearing member, for example, may have perforations for indicating the locations of image frames. Additional encoding means may be provided as known in the art for providing desired precise timing signals for the control of the various functions and components. Programming of a number of commercially available microprocessors such as an INTEL Model 8086 Microprocessor (which along with others can be used in the LCU 28 according to the present invention) is a conventional skill in the art.

Following such measurement of charge on an image frame of the surface 12, such frame portion of the image-bearing member 11 is moved to the next stage shown as BB. At the stage BB, the latent image pattern thereon is developed, that is, is made visible, with charged particles of toner. As is known, the toner particles are charged to a third potential having a polarity that usually is relatively opposite to the polarity of the charge remaining on the surface 12. As such, the oppositely charged toner particles are electrostatically attracted to the image pattern on the surface 12. The process of attraction is such that the greater the quantity of charge remaining on the surface 12 (as measured by means of the device 27), the heavier will be the quantity toner particles attracted thereat during such development. As shown, the stage BB accordingly therefore includes a development apparatus 30 that contains a two-component developer material 31 which comprises for example magnetizable carrier particles, and the charged toner particles for such development of the image pattern on the surface 12.

After such development, the portion of the image-bearing surface 12 carrying the toner image thereon, is then moved to the next stage CC. The stage CC, as shown, includes an image transfer station 33 where the visible toner image on the image frame is transferred to a surface of a suitable receiver sheet, such as a sheet of plain paper, which is fed in registration to the station 33 from a supply 32 thereof along a sheet travel path. After such image transfer, the copy sheet then travels to the fusing station of the present invention shown generally as 35. At the fusing station 35, the toner image on the sheet is permanently fused to such sheet, thereby forming a hard copy.

Meanwhile, the used portion of the surface 12, from which the toner image was transferred, is moved on towards the initial stage AA to again begin another imaging cycle. To ensure continued production of high quality hard copies during subsequent cycles of the above imaging process, the surface 12 is cleaned before it is again reused. Such cleaning is carried out at the stage DD where the residual charges are removed by a discharge lamp 34 and/or neutralized by a corona 36, and the residual particles are removed by a cleaning means or apparatus shown, for example, as 40.

Figure 2:
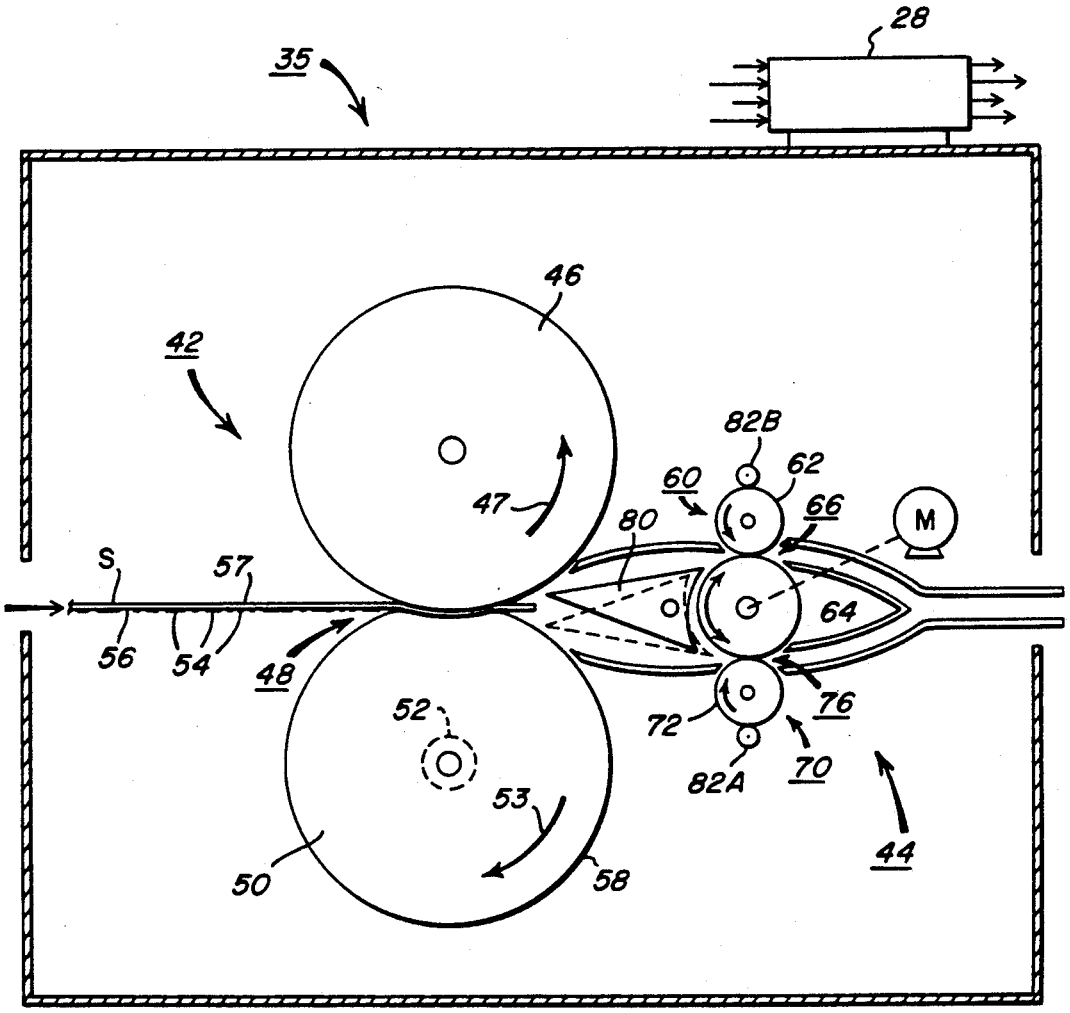
FIG. 2 is an enlarged schematic of the fusing apparatus and mechanism of the present invention.

Referring now to FIG. 2, the fusing station 35 of the present invention is shown in greater detail. As a process station of the copier or printer 10, the fusing station 35 and all its components are therefore under the control of the LCU 28. As shown, the station 35 includes a fusing apparatus 42, and the post-fusing decurling mechanism of the present invention shown generally as 44.

The fusing apparatus 42 includes a hard pressure roller 46 that is rotatable for example in the direction of the arrow 47, and that forms a fusing nip 48 with a heated soft surface fuser roller 50. Typically, the hard pressure roller 46 is made of a metallic shell, and the softer fuser roller 50 will have an elastomeric outer layer. Conventional means are provided for urging the rollers 46, 50 towards each other. The fuser roller 50 can be heated externally, or as shown internally by means such as a heat lamp 52. The fuser roller 50 is rotatable for example in the direction of the arrow 53 so as to cooperate with the pressure roller 46, to feed a receiver sheet S, which is carrying toner images 54 thereon, through the fusing nip 48. The sheet S is fed as such so that the heated fuser roller 50 directly contacts the toner images 54 on the image side 56 of the sheet S. Consequently, during such feeding the hard pressure roller 46 directly contacts the back side 57 of the sheet S.

Ordinarily, when the sheet S is fed as above through the fusing nip 48, the hard pressure roller 46 presses through the back 57 of the sheet such as to create a dent or depression in the part of the soft surface 58 of the fuser roller 50 that is in the nip 48 at any time. The effect of such pressing by the hard roller on the sheet S is an undesirable convex curl induced in the image side 56 of the sheet S as it exits the nip 48. In other words one ordinary effect of the hard roller and soft roller nip pressure on the sheet S is an undesirable backward curling tendency in such sheet S. Such backward curling is more likely to occur in sheets that carry lightly toned images, that is, sheets that do not have a heavily toned image pattern thereon.

However, sheets that carry heavily toned images, for example, sheets carrying continuous tone or half tone pictures or large solid areas, when fused as above, tend instead to exhibit an undesirable concave curl in the image side 56 of each such sheet. Such concave curling occurs particularly after the heated and fused toner image on the sheet cools, apparently thereby causing greater than ordinary surface contractions on the image side 56 of such sheet S.

In the copier or printer 10 of the present invention, prediction of which sheet S will curl convexly or concavely for example in the manners described above, can be reasonably achieved by control means that include the charge measurement device 27 and the LCU 28. As described above, the device 27 with the aid of the LCU 28 measures the quantity of charge remaining on each image frame portion of the initially uniformly charged image-bearing surface 12 following selective image-wise discharge. The degree of charged toner particle laydown on each such frame can thus be predicted from such measurements by comparing each measurement against a particular laydown at a predetermined or standard value of charge measurement. Such a predetermined or standard value of measured charge against which such predictions are to be made should be determined empirically for each machine.

In accordance with the present invention, the device 27, LCU 28 and the post-fusing decurling mechanism 44 are provided for removing undesirable convex and concave curls induced in the image side 56 of a receiver sheet S. As shown, the mechanism 44 has first means shown as 60 which include a first rotatable hard roller 62 and a rotatable soft roller 64. The first hard roller 62 is biased by conventional means such as 82B towards a soft roller 64 to form a first decurling nip 66 through which a sheet S exiting the fusing nip 48 can be fed. The sheet S is fed therethrough such that the soft roller 64 which is dented or depressed by the hard roller 62, directly contacts the image-carrying side 56 thereof as such sheet is being subjected to decurling contact through such first decurling nip 66. Such decurling contact in the nip 66 induces a desirable convex curl in the image-carrying side 56 of the sheet S because of the depression of the soft roller 64. As such, an undesirable concave curl induced by the fusing apparatus 42 in the side 56 of sheet S can be desirably removed by such decurling contact. In accordance with the present invention, a sheet S predicted by the means 27, 28 to be heavily toned, that is, a sheet with a predicted heavier than standard toner laydown, will be selectively fed through the first decurling nip 66 in order to remove the undesirable concave curl that would be induced in the side 56 thereof after fusing.

As further shown, the decurling mechanism 44 also has second means shown as 70 which include a second rotatable hard roller 72 that is also biased by conventional means such as 82A towards the rotatable soft roller 64. The second hard roller 72 and the soft roller 64 form a second decurling nip 76 through which a sheet S exiting the fusing nip 48 can also be fed. The pressure of the second hard roller 72 on the soft roller 64 also causes the soft roller 64 to dent or be depressed at the nip 76 as the soft roller 64 accommodates itself to the hard roller 72. The sheet S is fed therethrough such that the second hard roller 72 directly contacts the image-carrying side 56 of the sheet as such sheet S is being subjected to decurling contact through such second decurling nip 76. Such decurling contact 76 induces a desirable concave curl in the image-carrying side 56 of the sheet S. As such, an undesirable convex curl previously induced in such side 56 by the fusing apparatus 42, for example, can be desirably removed by feeding such sheet S into such decurling contact. In accordance with the present invention, a sheet predicted by the means 27, 28 to be lightly toned, for example, will be fed through the second decurling nip 76 in order to remove the undesirable convex curl that ordinarily would be induced in the side 56 of such sheet during fusing.

Accordingly, the method of the present invention for removing undesirable concave and convex curls induced in the image side of a receiver sheet fed through a heated fusing nip of the copier or printer 10 includes the following steps. The first step is measuring the quantity of charge on each image frame of the image-bearing surface following image-wise discharge, and comparing such measurement to a predetermined or standard value of charge measurement in order to predict whether the toner particle laydown on such a frame will be heavier or lighter than a laydown at such predetermined or standard charge value measurement. The next step which occurs after each sheet is fused, is to selectively deflect each such sheet, exiting the fusing nip 48, by a control means which is responsive to a signal from the LCU 28, and which means includes, for example, a sheet deflector 80. The sheet S is selectively deflected into decurling contact through either the first decurling nip 66 or through the second decurling nip 76. As discussed above, the selective deflection is such that a heavily toned sheet which would otherwise tend to curl concavely to the image side 56 is deflected through the first decurling nip 66, and a lightly toned sheet which would otherwise exhibit a convex curl in such image side 56 is deflected instead through the second decurling nip 76.

As further shown, the first means 60 and second means 70 share the common soft roller 64 which consequently must be rotatable clockwise and counterclockwise. The roller 64 for example can be the drive roller, and as such is coupled to drive means such as a motor M or to the main drive of the copier, and operated by a selectively actuated transmission arrangement for switching directions of rotations. In addition, the decurling mechanism 44 includes decurling-nip loading means, shown as 82A, 82B for variably loading each hard roller 62, 72 against the soft roller 64. Under the control of the LCU 28, such variable loading means can operate such that the heavier the predicted toner laydown on a sheet S, for example, the greater the load in the first decurling nip 66. Modifications of the present invention may include the use, for example, of a densitometer for determining the degree of toner laydown on each image frame or sheet after development. As is known, this can be accomplished by measuring and comparing the reflectivity of the developed image frame or of a single side image-carrying sheet. Further modifications, for example, may include a decurling mechanism with a plurality of soft rollers and a single hard roller or other feasible combination thereof.

For ensuring the removal of an undesirable curl in the sheet S, the soft roller 64, for example, may have substantially the same softness and diameter of the fuser roller, or the softness and nip pressures of the mechanism 44 can be varied appropriately.

As can be seen, an electrostatographic machine, such as a copier or printer 10 has been disclosed that includes a mechanism for removing undesirable concave and convex curls from image-carrying sheets used therein. The curling removing mechanism includes means for predicting the degree of toner laydown on each sheet, and for selectively feeding each sheet into decurling contact in either a first or a second decurling nip in order to remove undesirable concave or convex curls in the image side of the sheet. As a result, image-carrying sheets are produced that are flat, have a quality appearance, and are easy to handle following fusing in such copier or printer.

The invention has been described in detail with particular reference to preferred embodiments thereof, but it will be understood that variations and modifications can be effected within the spirit and scope of the invention.

What is claimed is:

1. In an electrostatographic process machine including a fusing apparatus for fusing toned images to a receiver sheet, a post-fusing decurling mechanism for reversing undesirable concave and convex curls induced in such sheet, the decurling mechanism comprising:

(a) first decurling means including a first rotatable hard roller and a rotatable soft roller for forming a first decurling nip such that said soft roller directly contacts the tone image-carrying side of a receiver sheet being fed into said first decurling nip to thereby induce a desirable convex curl in said image-carrying side of the sheet;

(b) second decurling means including a second rotatable hard roller and a rotatable soft roller for forming a second decurling nip such that said second hard roller directly contact the tone image-carrying side of a receiver sheet being fed into said second decurling nip to thereby induce a desirable concave curl in said image-carrying side;

(c) means for predicting a relatively degree of toner particle laydown of a toned image on a receiver sheet about to be fused; and (d) means for variably loading said first rotatable hard roller against said soft roller, such that the greater the relative degree of tone particle laydown of an image on a sheet being fed through said first nip, the greater the load of said first rotatable hard roller against said soft roller.

2. The decurling mechanism of claim 1 including decurling control means having a receiver sheet deflector for selectively deflecting the receiver sheet into either the first or second decurling nip.

3. The decurling mechanism of claim 1 wherein said first and second decurling means have a common soft roller.

4. The decurling mechanism of claim 3 and including means for selectively rotating said common soft roller both clockwise and counterclockwise.

5. In an electrostatographic process machine, such as a copier or printer, including a heat and pressure fusing apparatus for producing fused tone images on a receiver sheet, a decurling method for removing undesirable concave and convex curls induced in the toner image side of the receiver sheet, the method including the steps of:

(a) measuring charge on an image frame and deciding whether the toner particle laydown thereon constituting the image on the receiver sheet to be fused will be heavier or lighter than a toner particle laydown at a predetermined or standard value of charge measurement; and (b) selectively deflecting the receiver sheet coming from the fusing nip of the fusing apparatus into a first decurling nip or into a second decurling nip, such that a sheet, carrying a toned image from an image frame having a higher than said standard value charge measurement, is deflected through said first nip, said first and second decurling nips being formed by a rotatable soft roller and rotatable first and second hard rollers respectively, such that in said first decurling nip said soft roller directly contacts the image-carrying side of said fused receiver sheet to induce therein a convex curl in order to remove an undesirable concave curl previously induced therein, and such that in said second decurling nip said second hard roller directly contacts the image-carrying side of said receiver sheet to induce therein a concave curl in order to remove an undesirable convex curl previously induced therein.

6. The method of claim 5 wherein a receiver sheet having a heavier than the predetermined standard toner particle laydown is deflected into said first decurling nip.

7. The method of claim 5 wherein a receiver sheet having a toner particle laydown equal to or lighter than the predetermined toner particle laydown is deflected into said second decurling nip.

8. The method of claim 6 wherein a receiver sheet having a toner particle laydown equal to or lighter than the predetermined toner particle laydown is deflected into said second decurling nip.

9. In an electrostatographic machine such as a copier or printer for producing toner images on a receiver sheet, a fusing apparatus for fusing the toner images onto the sheet, the fusing apparatus comprising:

(a) a hard pressure roller;

(b) a soft heated fuser roller forming a fusing nip with said pressure roller for feeding a receiver sheet therethrough such that said fuser roller directly contacts the toner image side of the sheet; and (c) a decurling mechanism for removing undesirable concave and convex curls in the image side of the fused sheet, the decurling mechanism including:

(i) first means including a first rotatable hard roller and a rotatable sheet roller for forming a first decurling nip such that said soft roller directly contacts the toned image-carrying side of a receiver sheet being fed into said first decurling nip in order to induce a desirable convex curl in said image-carrying side of the sheet;

(ii) second means including a second rotatable hard roller and a rotatable soft roller for forming a second decurling nip such that said second hard roller directly contacts the tone image-carrying side of a receiver sheet being fed into said second decurling nip in order to induce a desirable concave curl in said image-carrying side of the sheet; and (iii) decurling control means including a receiver sheet deflector for selectively deflecting the receiver sheet into either the first or second decurling nip, said control means including toner particle laydown predictive means wherein a receiver sheet receiving a toner particle laydown lighter than a standard toner particle laydown value is selectively deflected into contact in said second decurling nip.

10. An electrostatographic apparatus for producing toned images on a receiver sheet, the apparatus including:

(a) an image-bearing surface (IBS);

(b) means for uniformly charging the IBS to a first potential having a desired polarity;

(c) means for selectively discharging portions of said charged IBS to form a latent image pattern thereon;

(d) means for measuring charge remaining on said IBS following such selective discharge;

(e) means for comparing said measurement of charge on the IBS against a predetermined reference value;

(f) means for developing the image pattern with toner particles, such that the greater the quantity of charge remaining on the IBS following selective discharge, the heavier the toner particle laydown;

(g) means for transferring the toner developed image onto a surface of a receiver sheet;

(h) a fusing apparatus including a rotatable soft heated fuser roller and a rotatable hard pressure roller for fusing the toner developed image onto the sheet such that the fuser roller directly contact the image-carrying side of the sheet; and (i) decurling mechanism for removing undesirable concave and convex curls in the image-side of the fused sheet, the decurling mechanism comprising:

(a) first means including a first rotatable hard roller and a rotatable soft roller for forming a first decurling nip such that said soft roller directly contacts the tone image-carrying side of a receiver sheet being fed into said first decurling nip in order to induce a desirable convex curl in said image-carrying side of the sheet;

(b) second means including a second rotatable hard roller and a rotatable soft roller for forming a second decurling nip such that said second hard roller directly contacts the toned image-carrying side of a receiver sheet being fed into said second decurling nip in order to induce a desirable concave curl in said image-carrying side of the sheet; and (c) decurling control means including a receiver sheet deflector for selectively deflecting the receiver sheet into either the first or second decurling nip, such that a receiver sheet, transfer-receiving a toned image from an image pattern having a charge value higher than said predetermined reference charge value, is selectively deflected through said first nip.

11. The electrostatographic apparatus of claim 10 wherein said decurling mechanism includes means for variably loading each of said first and second hard rollers against said soft roller.

12. The electrostatographic apparatus of claim 10 wherein said decurling mechanism includes a single soft roller mounted rotatably between said first and said second hard rollers.

13. The electrostatographic apparatus of claim 10 wherein a receiver sheet predictively receiving a heavier than standard quantity of toner particle laydown is fed by said decurling control means through said first decurling nip.

14. The electrostatographic apparatus of claim 10 wherein said decurling control means includes:

(a) a logic and control unit having a microprocessor;

(b) means associated with said logic and control unit for measuring the quantity of charge on the image bearing member; and (c) a receiver sheet deflector for selectively deflecting a receiver sheet exiting the fusing nip of the fusing apparatus into decurling either said first or said second decurling nip.

15. The apparatus of claim 11 wherein said variable loading means is controlled such that the heavier the toner particle laydown, the greater the load in said first decurling nip.

16. The apparatus of claim 12 wherein said single soft roller is selectively rotatable clockwise or counterclockwise.

* * * * *

UNITED STATES PATENT AND TRADEMARK OFFICE

CERTIFICATE OF CORRECTION

PATENT NO. : 5,084,731
DATED : January 28, 1992
INVENTOR(S) : Susan C. Baruch

It is certified that error appears in the above-indentified patent and that said Letters Patent is hereby corrected as shown below:

| | |
|---|---|
| Col. 7, Claim 1, line 26 | after "the" "tone" should be --toned-- |
| Col. 7, Claim 1, line 33 | after "the" "tone" should be --toned-- |
| Col. 7, Claim 1, line 33 | after "directly" "contact" should be --contacts-- |
| Col. 7, Claim 1, line 37 | "relatively" should be --relative-- |
| Col. 7, Claim 1, line 42 | "tone" should be --toner-- |
| Col. 7, Claim 5, line 58 | "tone" should be --toner-- |
| Col. 8, Claim 9, line 46 | after "rotatable" "sheet" should be --soft-- |
| Col. 8, Claim 9, line 55 | after "the" "tone" should be --toned-- |

UNITED STATES PATENT AND TRADEMARK OFFICE

CERTIFICATE OF CORRECTION

PATENT NO. : 5,084,731
DATED : January 28, 1992
INVENTOR(S) : Susan C. Baruch

It is certified that error appears in the above-indentified patent and that said Letters Patent is hereby corrected as shown below:

Col. 10, Claim 14, line 32 after "into" delete --decurling--

Signed and Sealed this
Eighth Day of June, 1993

*Attest:*

Michael K. Kirk

MICHAEL K. KIRK

*Attesting Officer*

*Acting Commissioner of Patents and Trademarks*